US005213536A

United States Patent [19]

Hough et al.

[11] Patent Number: 5,213,536

[45] Date of Patent: May 25, 1993

[54] FILAMENTED LAMP MANUFACTURE METHOD

[75] Inventors: Harold L. Hough, Beverly; George J. English, Reading, both of Mass.

[73] Assignee: GTE Products Corporation, Danvers, Mass.

[21] Appl. No.: 636,806

[22] Filed: Jan. 2, 1991

[51] Int. Cl.[5] ..... H01J 9/24; H01K 3/20; H01K 3/22

[52] U.S. Cl. ..... 445/27; 445/16; 445/40; 445/43; 65/59.27

[58] Field of Search ..... 445/22, 27, 43, 16, 445/40; 65/59.25, 59.27, 79

[56] References Cited

U.S. PATENT DOCUMENTS

| | | | |
|---|---|---|---|
| 3,162,499 | 12/1964 | Gustin | 445/54 |
| 3,295,016 | 12/1966 | Ayres et al. | 445/27 |
| 3,462,209 | 8/1969 | Fridrich | 445/27 |
| 3,685,880 | 8/1972 | Sobieski | 316/19 |
| 3,759,601 | 9/1973 | Bonazoli et al. | 445/27 |
| 4,434,386 | 2/1984 | Lowe | 445/22 |
| 5,008,592 | 4/1991 | Pragt | 445/27 |

FOREIGN PATENT DOCUMENTS

| | | | |
|---|---|---|---|
| 2045519 | 10/1980 | United Kingdom | 65/59.25 |

*Primary Examiner*—Richard K. Seidel
*Assistant Examiner*—Jeffrey T. Knapp
*Attorney, Agent, or Firm*—William E. Meyer

[57] ABSTRACT

A method of fabricating a filamented capsule from a tubular blank, and a mold used in such fabrication, is provided wherein a first filament is sealed in a first press seal in one end of the blank, and a preform designed to facilitate insertion and positioning of a second filament is formed in an opposite end of the blank, in a single pressing and blowing step.

10 Claims, 7 Drawing Sheets

FILAMENTED LAMP MANUFACTURE METHOD

BACKGROUND OF THE INVENTION

1. Field of the Invention

The invention relates to the fabrication of electric lamps, and in particular to the fabrication of capsules for use in filamented lamps. Although the invention is applicable to filamented lamp tubes of any size, it is particularly useful to relatively small, low wattage lamps.

2. Description of the Prior Art

Although relatively expensive to manufacture, small volume tungsten halogen filamented lamps are gaining commercial interest due to their superior light output and energy efficiency, especially when coated with an optically reflective coating. Typically, the fabrication of a double ended, filamented capsule for a tungsten halogen lamp includes a series of separate steps. For example, one known method includes the following steps: (1) Starting with a quartz tube an appropriate length, one end is heat sealed. (2) The tube is then loaded in a lathe chuck system that may be vertical or horizontal oriented. (3) The tube is rotated in the lathe and an appropriate length is heated to its working temperature. (4) The molten glass is captured in a two-part mold and nitrogen is blown into the tube through the open end. The positive pressure causes the heated glass tube to fill the mold to form a shaped capsule. (5) The shaped capsule is trimmed to length. (6) An exhaust tube is sealed onto the body of the capsule. (7) The capsule is acid-washed, dried and vacuum-baked to reduce possible contamination. (8) A filament assembly is loaded into the capsule. (9) The filament assembly is sealed in the capsule. (10) The capsule is then exhausted and filled with a halogen lamp fill through the exhaust tube. (11) The lamp capsule is finally tipped off to seal in the lamp fill.

As is readily apparent from the number of individual steps involved, the cost of manufacturing a small filamented lamp capsule may be relatively high. There are numerous chances for contaminants to be introduced into the process, hence the need for the washing, drying and baking steps during the course of fabrication.

Use of tungsten halogen lamps in areas requiring high reliability, and miniaturization, such as the auto industry, has intensified the need to avoid the long and costly manufacturing process. A more uniformly shaped volume and a tipless lamp capsule may be preferred features to avoid degradation of the lamp's optical qualities, and in particular where the lamp capsule is to receive an infrared reflective coating on the capsule surface. All of these features are particularly difficult to achieve in small filamented lamps, for example those having a volume less than two milliliters.

There is a need for a fabrication technique which reduces costs by simplifying the manufacturing process, and still address the specific problems encountered in low wattage lamps. There is also a need to provide a fabrication technique which provides a means of positioning filaments in an capsule in a repeatable manner. It may also be desirable to provide a lamp capsule having a uniformly shaped volume and one which is tipless. It is also desirable to achieve these features in a small volume filamented lamp.

SUMMARY OF THE INVENTION

Small filamented lamps may be formed from a tubular blank having a circular cross section. The capsule includes an elongated body, a bulbous midsection hermetically enclosing an interior volume, and two opposed ends adjacent to the midsection. Each of the ends has a hermetic seal formed therein and a filament end mounted in each seal. The filament extends across the interior of the bulbous midsection. The fabrication method comprises the steps of loading a first end of the blank over a filament and heating the blank to pliability while flowing an inert gas through the blank to prevent filament oxidation. The blank is then pressed and blow molded while blowing into a second end of the blank. The press molding (1) forms a first press seal at the first filament end thereby mounting the first filament end in the first press seal; (2) forms the bulbous midsection; and (3) preforms the second end of the blank. The preformed second end may include a first region adjacent the bulbous midsection which has a first cross section configured for guiding a second filament end, and a second region adjacent the first region and having a second cross section configured for guiding the foil of the second filament end relative to the second end of the blank. The preformed second end may also nearly approximate the final second seal configuration. The bulbous midsection may then be gas processed and filled with a portion of the lamp fill. The second filament end is finally positioned in the second end, the foil of the second filament end being oriented relative to the first filament, and envelope. A final gas fill is added into the bulbous midsection. The final step is to form a second hermetic seal at the second end thereby mounting the second filament end in the second hermetic seal.

DESCRIPTION OF THE PREFERRED EMBODIMENT

Figure 1:
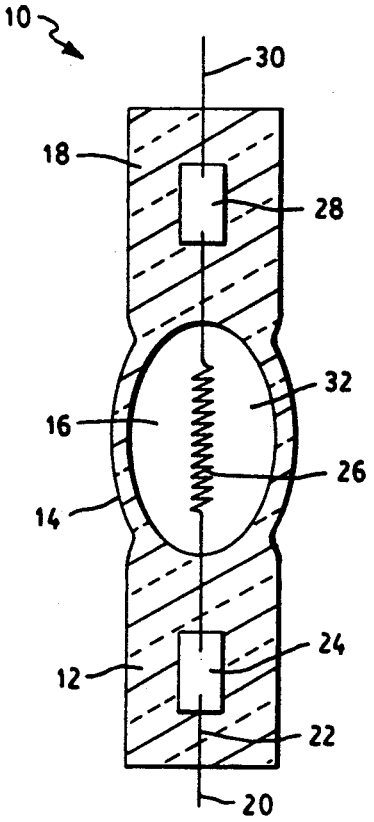
FIG. 1 shows a filamented capsule formed in accordance with the method of the invention with foil seals.
Figure 2:
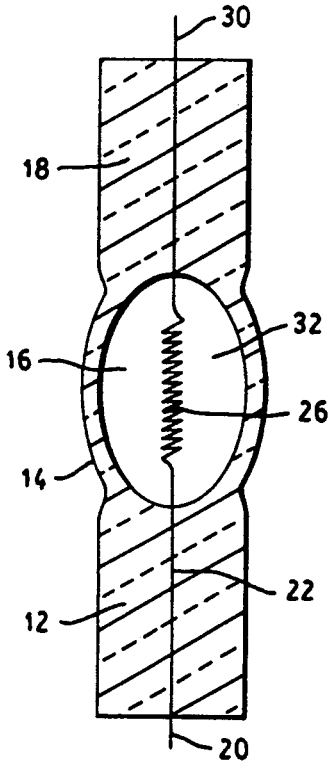
FIG. 2 shows a filamented capsule formed in accordance with the method of the invention without foil seals.

A preferred embodiment of the invention is illustrated in the drawings. The method of the invention is directed to the fabrication of a filamented capsule 10 having a first sealed end 12, an elongated body including a bulbous midsection 14, which hermetically encloses an enclosed volume 16, and an opposite second sealed end 18. Hermetically sealed through and between the first sealed end 12 and the second sealed end 18 is a filament structure 20, having a first lead 22, an optional first foil 24, an intermediate coil 26, an optional second foil 28 and a second lead 30. In addition, positioned in the enclosed volume 16 is a lamp fill 32. FIG. 1 shows a small volume, tipless double ended filament lamp including foils made by the following method. FIG. 2 shows a similar lamp without foils.

The procedure embodying the invention divides the fabrication of filamented capsule 10 into a reduced number of steps as diagrammatically depicted in the drawings. For convenience, portions of the capsule 10 and assembly equipment are referred to herein as upper or lower elements. It should be understood that once the capsule 10 is completed, the lamp ends are functionally equivalent, and reference terms upper and lower have no further significance.

Figure 3:
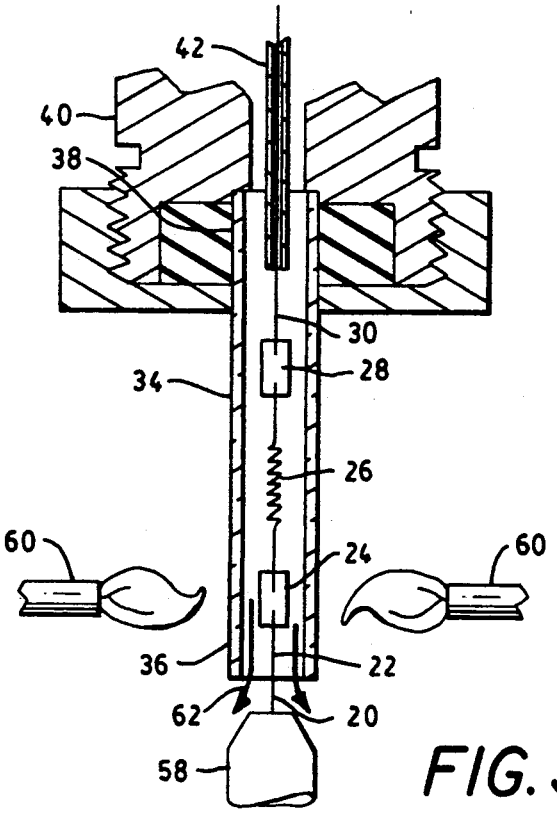
FIG. 3 is a diagrammatic representation of a first step of the method for making a filamented lamp.

Referring to FIG. 3, in the first step, a preform for the capsule 10 is selected in the form of a tubular quartz or hard glass blank 34 having a circular cross section, a lower end 36 and an upper end 38. The upper end 38 is mounted to form a gas tight seal with a seal head 40. A filament structure 20, having a lower lead 22, a lower foil 24, an intermediate coil 26, an upper foil 28 and an upper lead 30 is held along the upper lead 30 by a support needle 42. In one embodiment, the support needle 42 is a hollow shaft with an internal diameter nearly equal to the outer diameter of the upper lead 30. The upper lead 30 can then be tightly positioned by a compression fit in the support needle 42.

Figure 4:
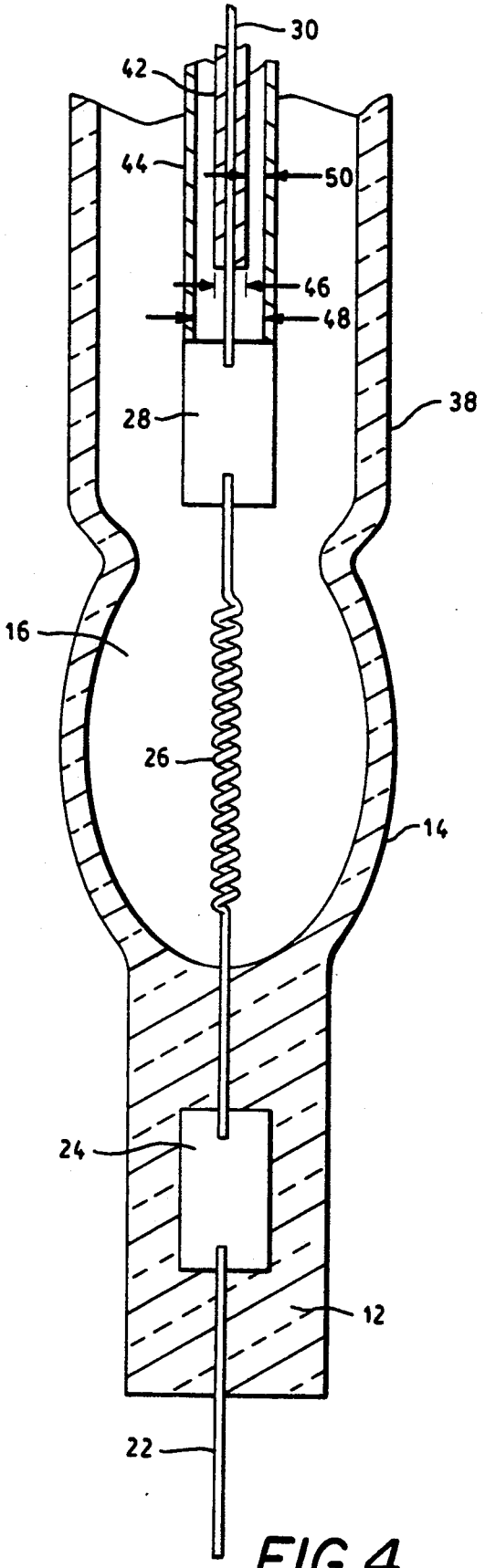
FIG. 4 shows a cross sectional view of a lamp capsule in construction, having sealing foils, and a narrow gas flow needle.

An alternatively preferred method is to further coaxially enclose the upper lead 30, and the support needle 42 in a gas flow needle 44. The support needle 42 has a smaller outer diameter 46 than the inner diameter 48 of the gas flow needle 44. A gap 50 is then formed between the support needle 42 and the gas flow needle 44 through which a gas may be flowed. In the case where a quartz envelope is used, foil seals, such as lower foil 24, and upper foil 28 are required. The gas flow needle 44 may then extend down to the upper end of the upper, second foil 28, whereafter gas diffusion may be used to control the gas condition of the enclosed volume 16. FIG. 4 shows a cross sectional view of a lamp capsule in construction, having sealing foils, and a narrow gas flow needle 44 inserted over the second lead 30, and the support needle 42, and stopped adjacent the upper end of the second foil 28.

Figure 5:
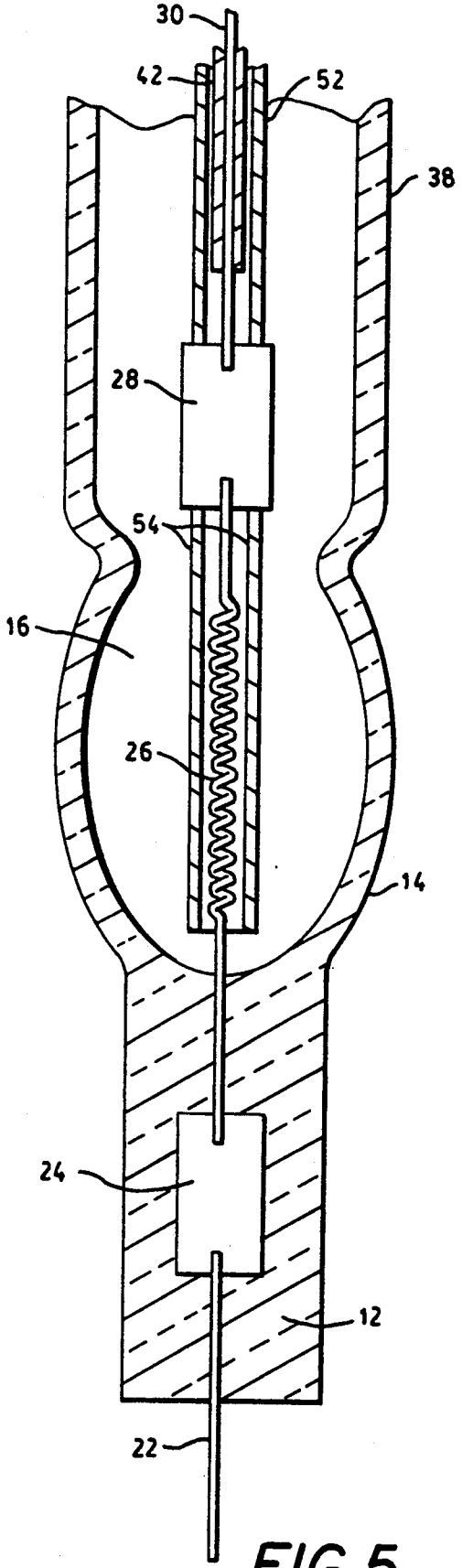
FIG. 5 shows a cross sectional view of a lamp capsule in construction, having sealing foils, and a narrow gas flow needle with a split lower end.

In a next alternative, as shown in FIG. 5 the gas supply needle 52 may be split by two diametrically opposed slots 54 for a portion of its lower length. The split gas supply needle 52 may then guide the foil edges in the slots 54, and extend down into the enclosed volume 16 to position, stabilize and protect the coil 26. FIG. 5 shows a cross sectional view of a lamp capsule in construction, having sealing foils 24, 28 and a narrow, split end gas flow needle 52.

Figure 6:
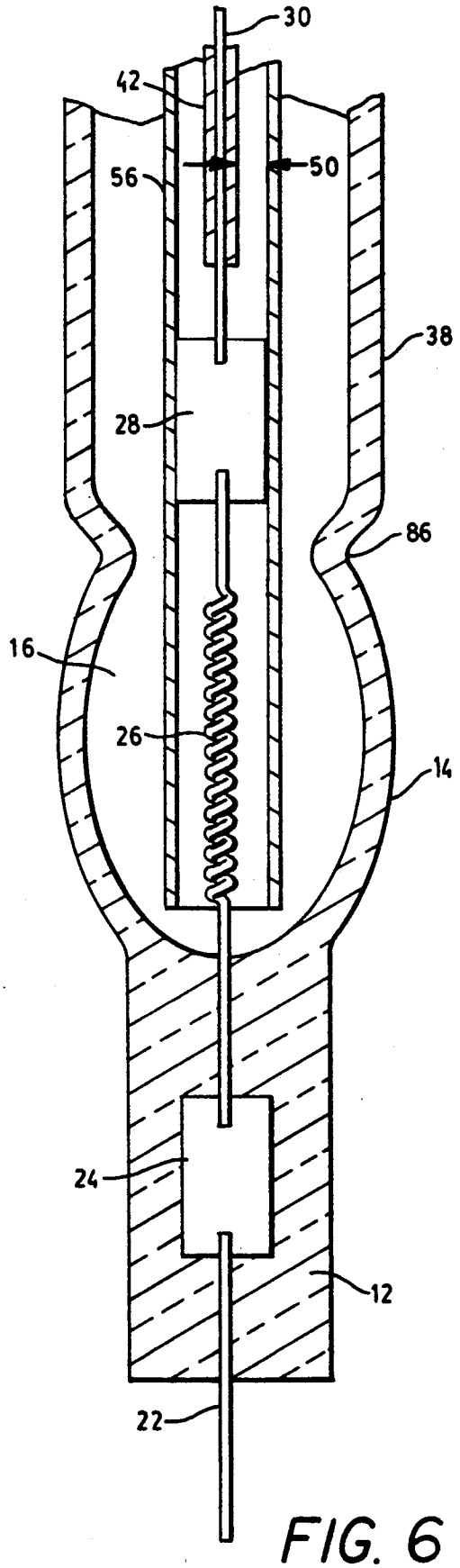
FIG. 6 shows a cross sectional view of a lamp capsule in construction, having sealing foils, and a broad gas flow needle passing over a sealing foil.

In a further alternative, the inner diameter of the gas flow needle may be large enough to pass over the upper, second foil 28. Such a large diameter gas flow needle 56 may then pass over the upper foil 28 and extend into the enclosed volume 16, over the coil 26. A large diameter gas flow needle 56 may however, have an outer diameter that conflicts with the neck 86. FIG. 6 shows a cross sectional view of a lamp capsule in construction, having sealing foils, and a large diameter gas flow needle 56 passing over the second sealing foil 28. Proper selection of the second foil 28, blank 34, and gas flow needle 44 or 52, sizes is needed to address the problem.

Figure 7:
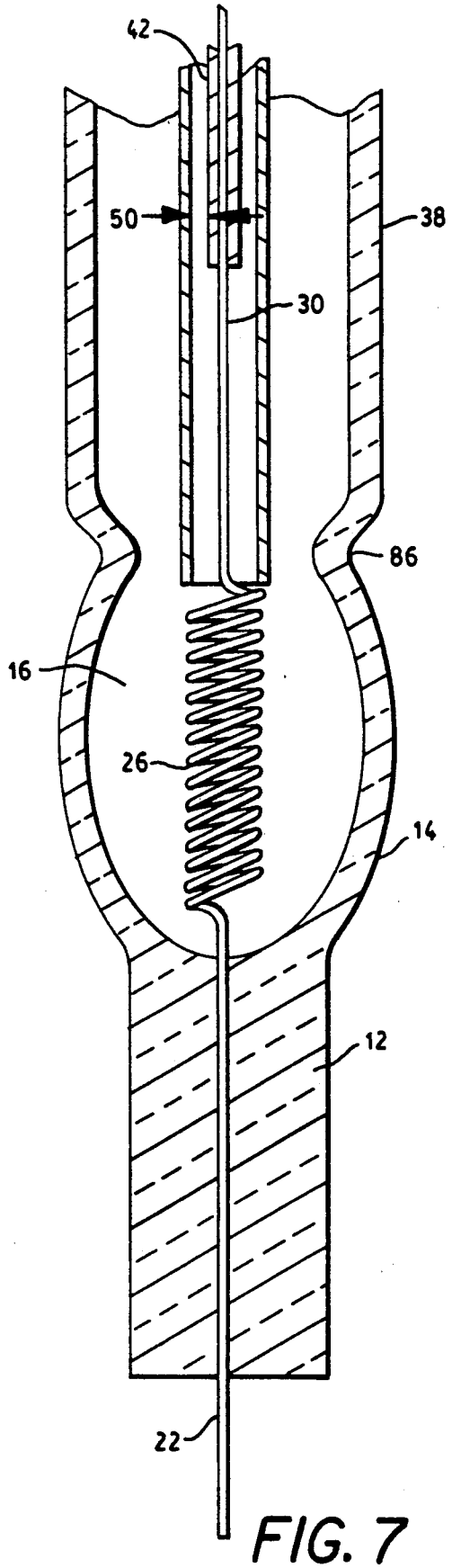
FIG. 7 shows a cross sectional view of a lamp capsule in construction, without sealing foils, and a narrow gas flow needle.
Figure 8:
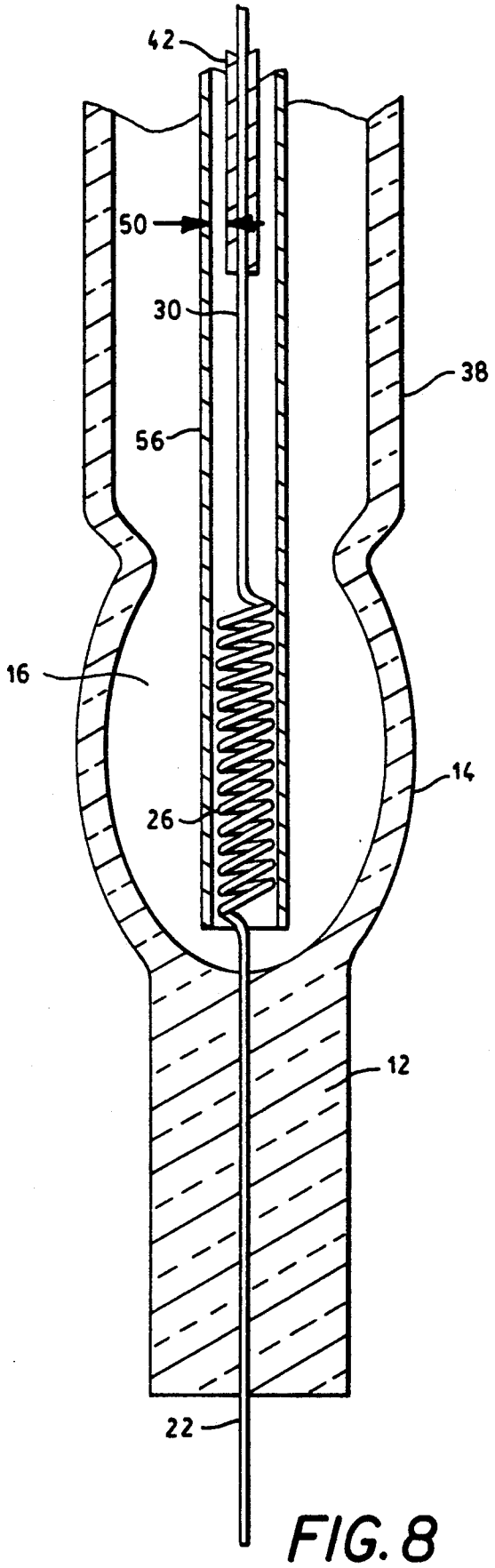
FIG. 8 shows a cross sectional view of a lamp capsule in construction, without sealing foils, and a broad gas flow needle passing over the coil.

In a still further alternative, a hard glass envelope may be used, in which case, the lower foil 24, and upper foil 28 may be eliminated, and straight leads may connect the coil 26. With a straight lead construction, with the upper lead 30 positioned in the support needle 42, the gas flow needle 44 may be extended down into the enclosed volume 16 to a point adjacent the coil 26. FIG. 7 shows a cross sectional view of a lamp capsule in construction, without sealing foils, and a narrow gas flow needle 44 extending down to be adjacent the upper end of the coil 26. In still another alternative, FIG. 8 shows a cross sectional view of a lamp capsule 10 in construction, without sealing foils, with a large diameter gas flow needle 56 passing over the coil 26. If the gas flow needle's inner diameter is large enough, the gas flow needle 56 may be fitted over the coil 26. By extending the gas flow needle 56 over the coil 26, the coil 26 may be held in an inert gas flow when the first seal is made, and simultaneously be held in position by the inner diameter of the gas flow needle 56. The preferred filament structure assembly is then a first lead 22 connecting to a coil 26, connecting to a second lead 30. The second lead 30 is captured in a support needle 42. The coil 26, the second lead 30, and the support needle 42 are then enclosed in a gas flow needle 56 having an inner diameter approximately equal to the diameter of the coil 26, and larger than the outer diameter of the support needle 42 to thereby form a gap 50 between the support needle 42, and the gas flow needle 56.

Next, the chosen filament structure assembled with the support needle 42, and the gas flow needle (44, 52, or 56), if any, is lowered through the blank 34 to expose the lower lead 22 from the lower end 36. The filament structure 20 is positioned axially in the blank 34 the proper distance, so the lower lead 22, and lower foil 24 are properly aligned for final sealing. The exposed lower lead 22 is then grasped by a chuck 58 to securely, and accurately position the lower lead 22, and indirectly thereafter the lower foil 24, and coil 26, all with respect to the blank 34. The upper foil 28, and and upper lead 30 are similarly securely held and accurately positioned by the support needle 42 and the gas flow needle 44, 52, or 56 if one is used. After the lower lead 22 and lower foil 24 are positioned in the lower end 36, the blank 34 is heated to pliability, the arrows 60 signifying the application of heat in a conventional manner, for example by gas flames. A flow of an inert gas 62, for example, argon, or nitrogen is supplied from the seal head 40 to flow, around the filament structure 20, and through the blank 34 and out around the lower chuck 58. The argon flow during the heating of the blank 34 prevents the oxidation of the filament structure 20. The argon flow may be supplied through the blank 34, or through the gas flow needle 44, 52, 56 according to the filament structure chosen.

Figure 9:
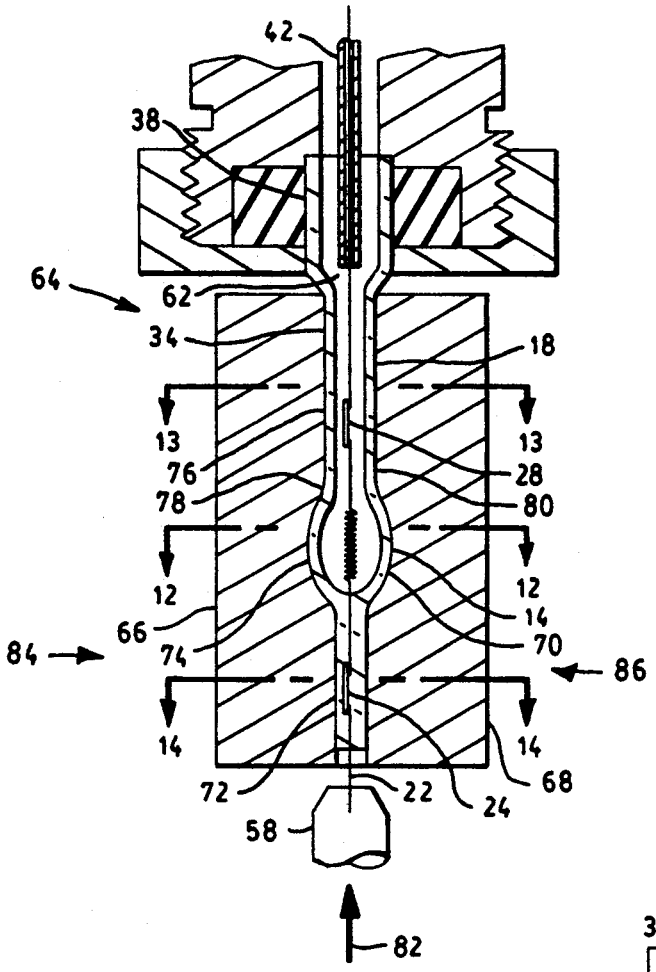
FIG. 9 is a diagrammatic representation of a second step of the method for making a filamented lamp.

The next step is depicted in FIG. 9 and involves pressing the pliable blank 34 in a mold 64 and simultaneously or closely in time thereafter, blowing in the upper end 38 thereof with a pressurizing gas 62. The preferred mold 64 includes a first half 66 and a second half 68 that define a mold cavity 70 therebetween. The first half 66 and second half 68 are preferably symmetric, mirror images. Each half of the mold 64 then provides substantially equal portions of the mold cavity 70. In the preferred embodiment the mold 64 includes lower section 72 forming a press seal portion for the first sealed end 12, a mold midsection 74, forming the bulbous midsection 14, and an upper mold section 76 forming a partial closure of the second sealed end 18. In particular, the preferred mold 64, adjacent the upper section 76 of the bulbous midsection 14 includes a neck 78 with a circular cross section to form a close, but not complete closure with the filament structure 20 between the coil 26 and upper foil 28. The preferred mold 64, above the neck 78, further includes a flatten cavity 80, adjacent the upper foil 28, to similarly approach, but not completely seal with the upper foil 28. In the alternatives where a gas flow needle 44, 52 or 56 is inserted to enclose a length of the second lead 30, second foil 28, or even the coil 26, the molded neck 78, or molded flattened cavity 80 portions may interfere with the gas flow needle 44, 52, or 56. The molded neck 78 and molded flattened cavity 80 portion may then be formed do not constrict the interior passage or eliminated to enable the withdrawal of the gas flow needle 44, 52 or 56 after molding. Otherwise, the mold halves 66, 68 and the mold cavity 70 therebetween may take numerous forms, each of which produce capsules with specific advantages. For example, the bulbous midsection 14 may take numerous forms. The elliptical form shown is currently preferred by the Applicants for use in some reflectively coated lamp designs. The mold 64 may also be formed to include heat conduction controls, mechanical couplings or other such protrusions, or indentations as may be elected by the lamp designer, as is generally known in the art.

Generally, the heated, and thereby pliable blank 34 may be pressed between the first mold half 66, and the opposite second mold half 68, where the mold halves are moved in directions normal to axis 82. For example, to press the pliable blank 34 the first mold half 66 and the second mold half 68 may be moved in the direction of arrows 84 and 86, respectively. Simultaneously, or sequentially close in time with the closing of the mold 64 around the pliable blank 34, a pressurizing gas 62 is supplied through the upper end 38, or through the gas flow needle 44, 52 or 56 as the case may be. The pressurizing gas 62 forces the pliable blank 34 toward the mold walls, thereby ensuring a more accurate formation of the capsule 10 shape. The simultaneous, or sequentially close in time, pressing and blowing of the pliable blank 34 forms the blank 34 in a nearly complete capsule 10 configuration. When no gas flow needle 44, 52, or 56 is present in the molded regions during molding, the upper end 38 is preferably only left sufficiently open to allow a gas flow around the upper end of the filament structure 20 between the enclosed volume 16 and the exterior. The narrowed passage of the upper end 38 allows the upper foil 28 and upper lead 30 to be properly positioned in the blank 34, but slightly offset from the inside wall of the blank 34. The preferred pressed and blown blank 34 then has a upper end 38 approximately in final form, whereby the envelope material of the upper end 38 needs only minimal final movement to complete the second seal 18. Minimal movement of the upper end 38 material to form the second seal 18 means the upper foil 28 and upper lead 30 are less likely to drift from their initial positions when the second seal 18 is heated and formed. When a gas flow needle 44, 52 or 56 is present in the molded regions during molding, the extent of nearly completed molding should be modified to allow subsequent withdrawal of the gas flow needle 44, 52 or 56.

During the pressing step depicted in FIG. 9, the first sealed end 12 is formed thereby sealing the lower lead 22 and lower foil 24 in place. During the pressing step depicted in FIG. 9, pressurizing gas 62 is blown in the blank 34 by means of a conduit in the sealing head 40, the conduit being coupled to a gas source (not shown). The combination of pressing together the mold halves 66 and 68 and blowing pressurizing gas 62 in the blank 34 forms the first sealed end 12, the bulbous midsection 14, and the narrowed guiding passage of the upper end 38, including the neck 78, and flattened cavity 80.

Figure 12:
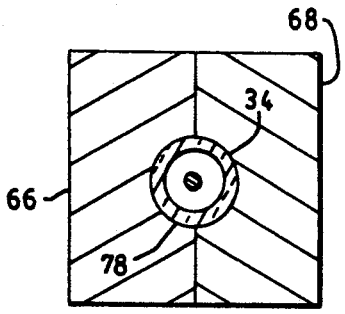
FIG. 12 is a view taken along lines 12—12 of FIG. 9.
Figure 13:
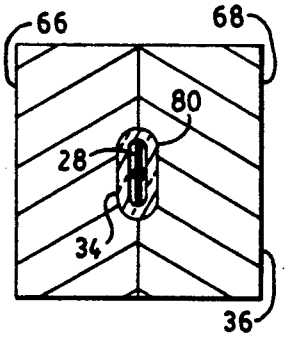
FIG. 13 is a view taken along lines 13—13 of FIG. 9.
Figure 14:
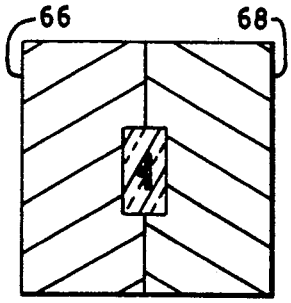
FIG. 14 is a view taken along lines 14—14 of FIG. 9.

In the preferred procedure, in addition to forming the bulbous midsection 14 and the first sealed end 12 by pressing mold sections 54 and 56 together and blowing gas 62 in the blank 34, the process may further partially form the second sealed end 18. In one alternative, the preformed upper end 38 may then be separately finished in a subsequent pressing, to complete the capsule 10 by known steps. The preferred partial formation of the second sealed end 18 includes forming the neck 78 adjacent the bulbous midsection 14 which may include a cross section (see FIG. 12 for cross section) configured for guiding the upper filament structure in the bulbous midsection 14, and adjacent the neck 78, a flattened cavity 80 and having a cross section 84 (see FIG. 13 for cross section) configured for rotationally guiding the upper foil 28. The mold cavity 70 is generally configured to press the pliable glass or quartz upper end 38 to form the neck 78 region 86. The neck 78 is configured to guide the upper filament end in the blank 34. In a preferred embodiment the mold cavity 70 includes a portion approximately complementary with but offset from the cross section of the upper foil 28 and upper lead 30. Preferably, the diameter of the mold cavity's cross section is as small as possible, yet sufficient to provide an aperture in the neck 78 around the upper foil 28, and upper lead 30 to allow gas flow between the enclosed volume 16 and the exterior.

Similarly, the mold cavity 70 may be configured to press the pliable upper end 38, and form the flattened cavity 80 to guide the upper foil 28. Once the press blowing is complete, the first mold half 66 and the second mold half 68 may be removed.

Figure 10:
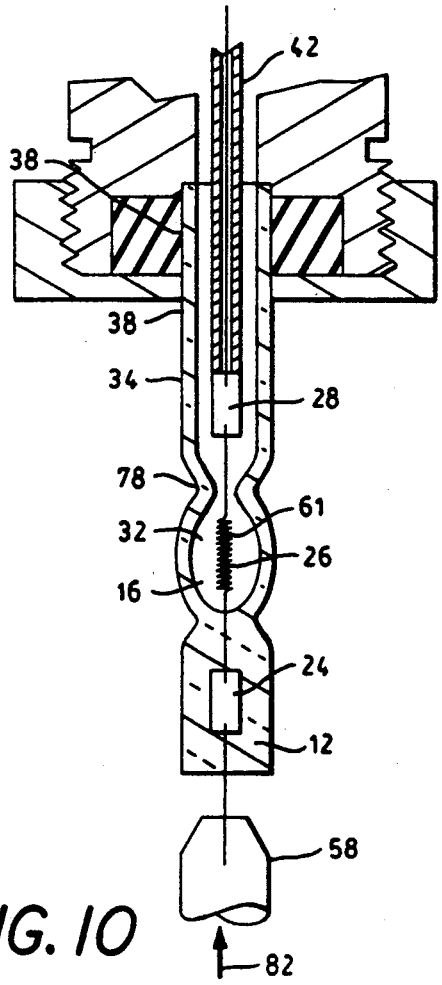
FIG. 10 is a diagrammatic representation of a third step of the method for making a filamented lamp.

The next step is depicted in FIG. 10 and involves dosing the bulbous midsection 14 with a portion of the particular lamp fill 32 selected. While it is possible to remove the partially sealed blank 34 from the seal head 40, and add the proper amount of the particular lamp fill 32, removal allows possible contamination of the enclosed volume 16. The preferred method is to leave the partially formed blank 34 in the sealing head 40. The lamp fill 32 may be inserted in the enclosed volume 16 either from the upper end of the blank, or through a gas flow needle 44, 52 or 56. A gas sealed containment vessel 88 positioned above the sealing head 40 may be used that includes the support needle 42 inert gas flow lines, pressurizing gas flow lines, a sheathing gas flow needle 44, 52 or 56, and other items. At necessary stages, the appropriate valves may be opened, and needles advanced or withdrawn as is appropriate to introduce a flush or fill gas, as the case may be, while the upper filament end 28 is held by support needle 42.

FIG. 10 shows the next step. The upper lead 30 is still held by the support needle 42. The upper foil 28 and upper lead 30 and blank 34 may then coact to align the upper filament end in the partially formed second seal end 18. Aligning the upper filament end allows the coil 26 position and tension to be controlled. The preferred method is to allow the inside surfaces of the partially formed second sealed end 18 to assist in rotationally aligning, and centering the upper filament structure. The proper distance from the lower filament end to the upper filament end is positively set by the vertical positioning of the support needle 42, thereby setting the tension, or coil stretch in the coil 26. The upper foil 28 and upper lead 30 are properly positioned in the blank 34 as depicted in FIG. 10, by moving the support needle 42 along the axis 82 in a downward direction until the desired coil 26 tension is achieved. Theoretically, an accurate positioning of the upper foil 28 and upper lead 30, and therefore of the coil 26 can be achieved by accurate control of the melted glass.

The next step is also depicted in FIG. 10 and involves adding a final gas fill in the enclosed volume 16. In the preferred procedure, to flush any contaminant gases from the enclosed volume 16, an inert flush gas 90 is cyclically pumped in and out of the blank 34 through seal head 40. In one embodiment, the flush gases may be pumped in and out at the upper end 38 of the blank 20, relying on diffusion to flush or fill the gas in the lower end of the blank 20. The diffusion method works slowly, and is less preferred. In the preferred embodiment, a gas flow needle 44, 52 or 56 extends down over the support needle 42 with a gap formed between the two needles. The inert flush gas 90 is then run through the gas flow needle 44, 52, or 56 in the gap 50 to emerge near the upper foil 28 or coil 26 as the case may be. Subsequently, the blank 34 is subjected to a high vacuum by means of seal head 40 to remove residual gases. A vacuum valve, not shown, may be closed to maintain a high vacuum in the blank 34. The flush and vacuum process cycle may be repeated as desired. A final gas lamp fill 32 below, at or above atmospheric pressure is then added to the blank 34. If a gas flow needle 44, 52 or 56 is present in the enclosed volume, the gas flow needle 44, 52 or 56 is now withdrawn from at least the enclosed volume 16.

Figure 11:
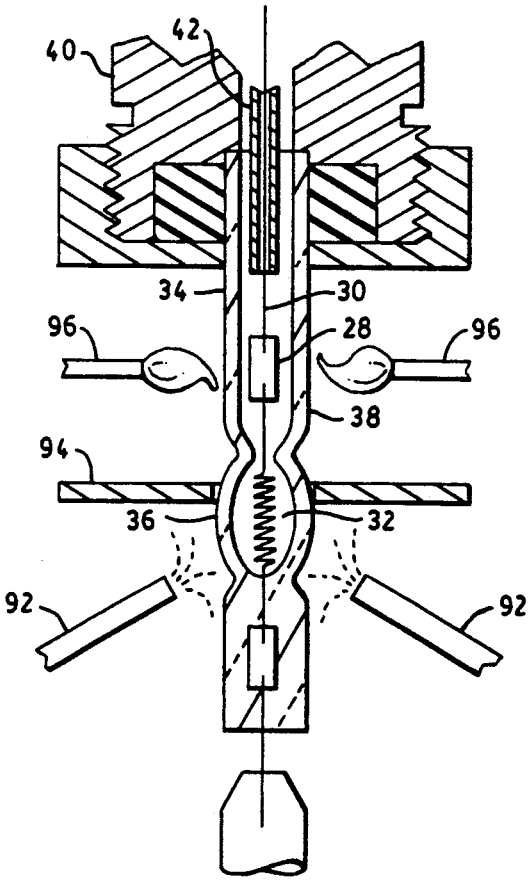
FIG. 11 is a diagrammatic representation of a fourth step of the method for making a filamented lamp.
Figure 15:
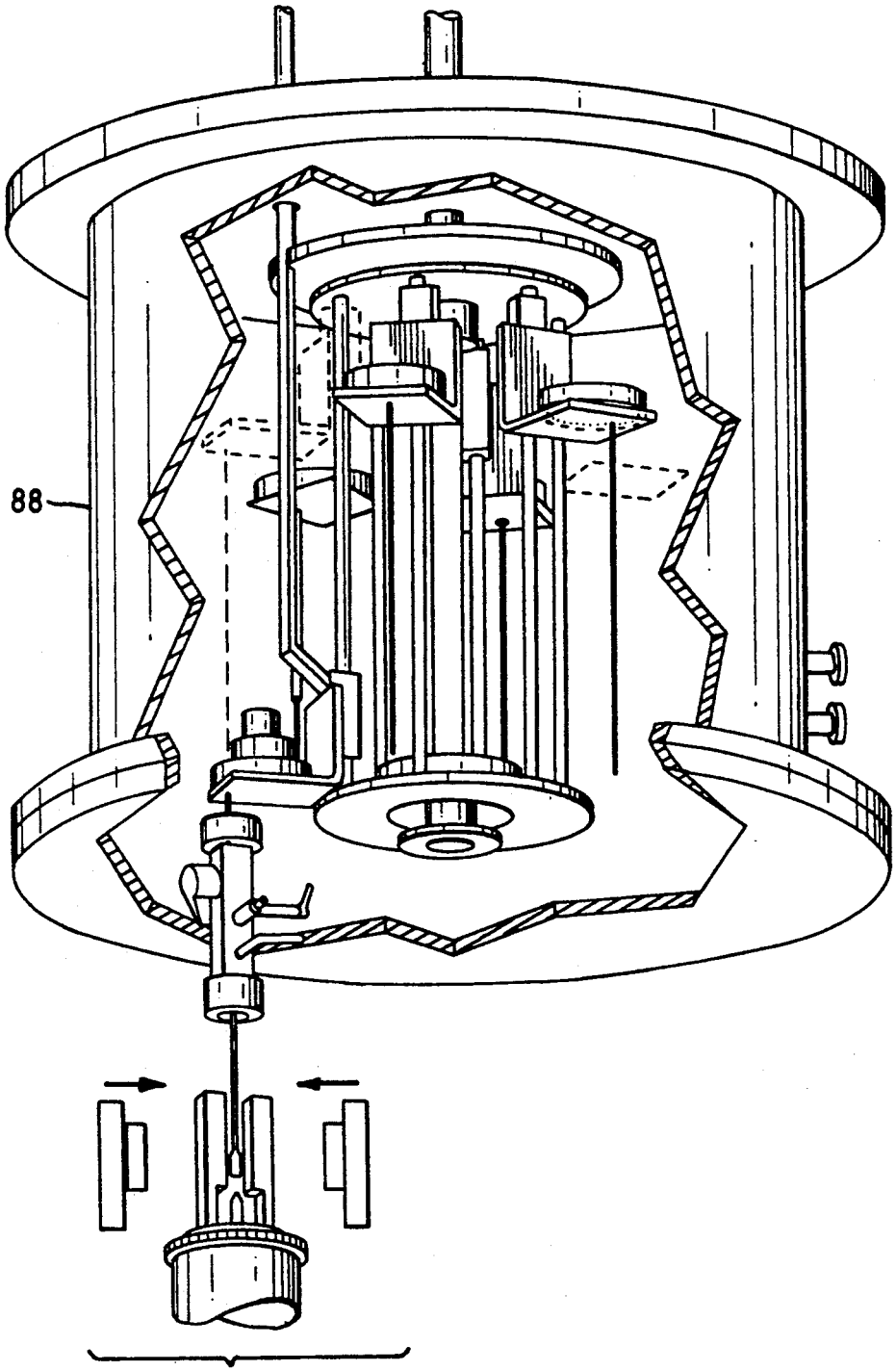
FIG. 15 is a diagrammatic representation of a carrousel gas chamber used in the lamp manufacture.

Next, as shown in FIG. 11, the blank 34 is submerged in or sprayed with liquid nitrogen 92 to freeze out any gas in blank 34, the seal head 40. In the preferred method a spray shield 94 is positioned around the blank 34. A spray shield 94 comprising two carbon fiber half rings that may be fitted around the capsule 10. The preferred shield is a titanium sheet with a hole formed to closely fit, but not touch the broadest part of the bulb. The lower region of the blank 34 is then sprayed with liquid nitrogen 92. The liquid nitrogen 92 condenses the lamp fill 32 causing the lamp fill 32 to settle in the bottom of bulbous midsection 14.

The next step is also depicted in FIG. 11 and involves forming the second sealed end 18 at the upper end 38 thereby mounting the upper foil 28 and upper lead 30 in the second sealed end 18. Although this sealing step may be varied, in the preferred embodiment the blank 34 is heated in the region of the second sealed end 18 by applying heat in a manner similar to that used in FIG. 3 to heat the blank 34 along the second end. In the preferred method, the region above the spray shield 94 is heated by the rotary burners 96. The burners 96 are vertically indexed, but not rotated for this heating. The upper end 38 becomes pliable due to the heat from the rotary burners 96. Meanwhile, the lower end 36 continues to be sprayed with liquid nitrogen 92. In the bulbous midsection 14, the lamp fill 32 remains condensed by the liquid nitrogen 92. If the gas flow needle 44, 52 or 56 is in position around the second foil 28, or portions of the second lead 30 that are to be sealed, then the gas flow needle 44, 52 or 56 is withdrawn before the quartz or hard glass start moving to seal with the second foil 28 or second lead 30. The interior of the blank 34 may be kept at a lower pressure than the exterior, thereby causing a pressure difference induced force on the exterior of the blank 34. The pressure difference collapses the heated upper end 38 to form the second sealed end 18. The upper filament end 28 is then sealed in the second sealed end 18, and the lamp fill 32, is captured in the enclosed volume 16. In any event, a hermetic seal is formed between the quartz or hard glass blank 34 and upper foil 28, or lead 30 as the case may be.

Processing is completed by removing the filamented capsule 10 from the seal head 40 and chuck 58. Excess quartz or glass extending from the upper end 38 may be trimmed as needed to form the filamented capsule 10 of FIG. 1. A small volume, double ended, filamented lamp without a tubulation is thus formed by the disclosed method. The molded body of the lamp assures an accurately defined exterior surface. The lamp may then be coated with one or more reflective coatings by chemical vapor deposition, dip coating or other known methods as are known in the art. The accurately defined exterior surface in combination with the reflective coatings, and the accurately positioned filament provides a lamp with accurate interaction between the filament, and the light reflected from the reflective coatings back to the filament.

While there have been shown and described that are at present considered to be the preferred embodiments of the invention, it will be apparent to those skilled in the art that various changes and modifications can be made herein without departing from the scope of the invention defined by the appended claims.

What is claimed is:

1. A method of fabricating a capsule from a tubular blank, the blank having a circular cross section, a first end and a second end, the capsule having an elongated body, a bulbous midsection defining an interior enclosed volume, and two opposed capsule ends adjacent to the midsection, on opposite sides of the midsection, each of the capsule ends having a press seal formed therein and a filament structure having a first lead sealed in the first capsule end, a coil positioned in the enclosed volume, and a second lead sealed in the second capsule end, and a lamp fill in the interior, the method comprising the steps of:

(a) positioning the filament structure in the blank with the first lead held in place in a first end of the blank, the second lead held in place in a second end of the blank, and the second end of the blank positioned in a seal head, (b) positioning a hollow needle in the blank around a portion of the filament structure to be enclosed in the enclosed volume;

(c) heating the first end of the blank to pliability;

(d) pressing the blank and blowing in the second end of the blank thereby simultaneously (1) forming a first press seal at the first end of the blank thereby mounting the first lead in the first press seal; and (2) forming the bulbous midsection;

(e) adding a final lamp fill through the seal head to the enclosed volume;

(f) removing the hollow needle from around at least a portion of the filament structure to expose those portions to be contained in the enclosed volume, and those portions to be captured in the second seal, and (g) forming a second hermetic seal at the second end of the blank thereby mounting the second connection lead in the second hermetic seal.

2. The method as described in claim 1 wherein the adding step includes the further steps of:

(a) cyclically pumping inert gas in, and flushing the inert gas out of, the blank to remove contaminants in the blank;

(b) subjecting the blank to a high vacuum and removing residual gases from in the blank;

(c) maintaining the vacuum in the blank and adding the final lamp fill in the blank; and (d) cooling the first press seal end of the blank with liquid nitrogen and freezing out the lamp fill in the blank causing the lamp fill to condense in the bulbous midsection.

3. A method of fabricating a capsule from a tubular blank, the blank having a circular cross section, a first end and a second end, the capsule having an elongated body, a bulbous midsection defining an interior enclosed volume, and two opposed capsule ends adjacent to the midsection, on opposite sides of the midsection, each of the capsule ends having a press seal formed therein and a filament structure having a first lead sealed in the first capsule end, a coil positioned in the enclosed volume, and a second lead sealed in the second capsule end, and a lamp fill in the interior, the method comprising the steps of:

(a) positioning the filament structure in the blank with the first lead held in place in a first end of the blank, the second lead held in place in a second end of the blank, and the second end of the blank positioned in a seal head, (b) positioning a hollow needle in the blank around a portion of the filament structure to be enclosed in the enclosed volume;

(c) heating the first end of the blank to pliability;

(d) pressing the blank and blowing in the second end of the blank thereby simultaneously (1) forming a first press seal at the first end of the blank thereby mounting the first lead in the first press seal; and (2) forming the bulbous midsection;

(e) adding a final lamp fill through the seal head to the enclosed volume;

(f) removing the hollow needle from around at least a portion of the filament structure to expose those portions to be contained in the enclosed volume, and those portions to be captured in the second seal, and (g) forming a second hermetic seal at the second end of the blank by (1) heating to pliability the second end of the blank, (2) cooling the first press seal end of the blank with liquid nitrogen and (3) freezing out the lamp fill in the blank causing the lamp fill to condense in the bulbous midsection and induce a pressure reduction thereby causing the second end to collapse forming a second hermetic seal at the second end thereby mounting the second filament end in the second hermetic seal.

4. The method as described in claim 1 wherein the forming step includes the steps of:

(a) heating to pliability the second end of the blank; and (b) further pressing the second end of the blank and forming a second hermetic seal at the second end thereby mounting the second filament end in the second hermetic seal.

5. The method in claim 1 wherein a flush gas is flowed from the seal head through the blank during the heating of the first end.

6. The method in claim 5 wherein a flush gas is flowed from the seal head through the hollow needle.

7. The method in claim 1 wherein a flush gas is flowed from the seal head through the hollow needle during the heating of the first end.

8. The method in claim 1 wherein the hollow needle is lowered from the seal head into the enclosed volume to enclose at least a portion of the filament during the heating of the first end.

9. The method in claim 8 wherein a flush gas is flowed from the seal head through the hollow needle during the heating of the first end.

10. The method in claim 7 wherein a hollow needle is lowered from the seal head into the enclosed volume to enclose at least a portion of the filament, and to channel a flush gas around the filament during the heating of the first end.

* * * * *